US010214970B1

(12) United States Patent
Gupta et al.

(10) Patent No.: US 10,214,970 B1
(45) Date of Patent: Feb. 26, 2019

(54) POST AND NON-ELONGATED SUBSTRUCTURE DRILLING RIG

(71) Applicant: NABORS DRILLING TECHNOLOGIES USA, INC., Houston, TX (US)

(72) Inventors: Ashish Gupta, Houston, TX (US); Enrique Abarca, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/006,248

(22) Filed: Jun. 12, 2018

(51) Int. Cl.
*E21B 7/02* (2006.01)
*E21B 15/00* (2006.01)

(52) U.S. Cl.
CPC ..... *E21B 15/003* (2013.01)

(58) Field of Classification Search
CPC ..... E21B 15/003
See application file for complete search history.

(56) References Cited

U.S. PATENT DOCUMENTS 1,733,484 A 10/1929 Davis
2,332,479 A 10/1943 Woolslayer et al.
2,345,253 A 3/1944 Funk
2,347,115 A 4/1944 Lewis
2,594,847 A 4/1952 Bates et al.
3,028,881 A 4/1962 Koomey et al.
3,255,836 A * 6/1966 Hoppmann ..... B62D 57/00 180/8.6
3,433,268 A 3/1969 Greer
3,483,933 A 12/1969 Dyer et al.
3,576,225 A * 4/1971 Chambers ..... B65G 7/02 180/8.5
3,676,984 A 7/1972 Clark
3,716,149 A 2/1973 Scaggs
3,739,853 A 6/1973 Wales
(Continued)

FOREIGN PATENT DOCUMENTS

CA 2755483 A1 11/2010
CA 2753417 A1 2/2011
(Continued)

OTHER PUBLICATIONS

Nabors 990 Proyecto LLANOS.WMV; https://www.youtube.com/watch?v=6BgfgWumRIU, Nabors Rig 990 Cichimene, Colombia; Youtube.com; Aug. 10, 2011 (231 pages).
(Continued)

*Primary Examiner* — Robert E Fuller
(74) *Attorney, Agent, or Firm* — Adolph Locklar

(57) ABSTRACT

A land-based drilling rig includes a drill rig floor, the drill rig floor including a V-door, a side of the drill rig floor having the V-door defining a V-door side of the drill rig floor and an opposite V-door side of the drill rig floor opposite the V-door side of the drill rig floor. The land-based drilling rig also includes a mast, the mast mechanically coupled to the drill rig floor. Further, the land-based drilling rig includes at least four support bases, each support base coupled to the drill rig floor by a telescoping support arm, the support base and telescoping arm forming a support, wherein the support bases are square or cylindrical.

26 Claims, 9 Drawing Sheets

(56) References Cited

U.S. PATENT DOCUMENTS 3,802,137 A 4/1974 Armstrong
3,851,770 A 12/1974 Jenkins et al.
3,922,825 A 12/1975 Eddy et al.
3,937,334 A 2/1976 Bleyl et al.
3,942,593 A * 3/1976 Reeve, Jr. ..... E21B 7/023 173/186
3,991,887 A 11/1976 Trout
4,021,978 A 5/1977 Busse et al.
4,029,165 A * 6/1977 Miller ..... B62D 11/20 180/6.48
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A 7/1988 Willis
4,823,870 A 4/1989 Sorokan
4,834,604 A 5/1989 Brittain et al.
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A * 7/1999 Reed ..... B62D 57/00 180/8.1
6,161,358 A 12/2000 Mochizuki et al.
6,491,477 B2 12/2002 Bennett, Jr. et al.
6,581,525 B2 * 6/2003 Smith ..... B62D 55/00 104/96
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,306,055 B2 12/2007 Barnes
7,308,953 B2 12/2007 Barnes
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 * 5/2012 Springett ..... E21B 19/14 166/313
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,516,751 B2 8/2013 Konduc et al.
8,549,815 B2 10/2013 Donnally et al.
8,555,564 B2 10/2013 Wasterval
8,561,685 B2 10/2013 Rodgers
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 12/2014 Donnally et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 7/2015 Thiessen et al.
9,132,871 B2 9/2015 Crisp et al.
9,140,080 B2 9/2015 Flusche
9,151,412 B2 10/2015 Trevithick et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,488,014 B2 11/2016 Sparkman et al.
9,562,407 B2 2/2017 Magnuson
9,631,443 B2 4/2017 Folk
9,650,840 B2 5/2017 Cheng et al.
9,677,298 B2 6/2017 Konduc et al.
9,708,861 B2 7/2017 Reddy et al.
9,739,098 B2 * 8/2017 Fox ..... B65G 67/04
9,790,751 B2 10/2017 Reddy et al.
9,810,027 B2 11/2017 Reddy et al.
9,845,813 B2 12/2017 Shimizu et al.
9,879,442 B2 1/2018 Magnuson et al.
9,926,719 B2 3/2018 Reddy et al.
2002/0001255 A1 1/2002 Flood et al.
2003/0172599 A1 9/2003 Frink
2008/0237170 A1 10/2008 Altman et al.
2009/0000218 A1 1/2009 Lee et al.
2009/0025980 A1 1/2009 Callander et al.
2009/0053013 A1 2/2009 Maltby
2009/0200856 A1 8/2009 Chehade et al.
2009/0272540 A1 11/2009 Rodgers
2010/0186960 A1 7/2010 Reitsma et al.
2011/0072737 A1 3/2011 Wasterval
2011/0174545 A1 7/2011 Hartke et al.
2012/0168179 A1 7/2012 Having et al.
2012/0304553 A1 12/2012 Konduc et al.
2013/0305632 A1 11/2013 Rivera, Sr. et al.
2014/0014417 A1 1/2014 Smith et al.
2014/0054097 A1 * 2/2014 Bryant ..... E21F 13/006 180/8.1
2015/0315861 A1 11/2015 Zachariasen et al.
2016/0186495 A1 * 6/2016 Flusche ..... B62D 57/032 180/8.6
2016/0215592 A1 7/2016 Helms et al.
2016/0280524 A1 * 9/2016 Crisp ..... B65G 7/00
2016/0369570 A1 12/2016 Reddy et al.
2017/0106925 A1 4/2017 Gupta et al.
2017/0292334 A1 10/2017 Reddy et al.
2017/0350153 A1 12/2017 Reddy et al.
2018/0016851 A1 1/2018 Reddy et al.
2018/0030788 A1 2/2018 Reddy et al.

(56) References Cited

U.S. PATENT DOCUMENTS

| | | | |
|---|---|---|---|
| 2018/0119496 | A1 | 5/2018 | Reddy et al. |
| 2018/0128056 | A1 | 5/2018 | Gupta et al. |

FOREIGN PATENT DOCUMENTS

| | | | |
|---|---|---|---|
| CN | 201778661 | U | 3/2011 |
| DE | 849533 | C | 9/1952 |
| EP | 2751370 | B1 | 7/2014 |
| FR | 2556042 | A1 | 6/1985 |
| WO | 2016025521 | A2 | 2/2016 |
| WO | 2016048458 | A1 | 3/2016 |

OTHER PUBLICATIONS

Drilling Contractor; "Nabors modular Rig 702 in Papua New Guinea—bound for Exxon Mobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

POST AND NON-ELONGATED SUBSTRUCTURE DRILLING RIG

CROSS-REFERENCE TO RELATED APPLICATIONS

[None].

FIELD OF THE DISCLOSURE

The present disclosure relates generally to drilling rigs, and specifically to telescoping rig structures for land drilling in the petroleum exploration and production industry.

BACKGROUND OF THE DISCLOSURE

Land-based drilling rigs may be configured to be moved from location to location to drill multiple wells within the same area known as a wellsite. In certain situations, movement across an already drilled well for which there is a well-head in place may be desirable. Further, mast placement on land-drilling rigs may have an effect on drilling activity. For example, depending on mast placement on the drilling rig, an existing well-head may interfere with the location of land-situated equipment such as, for instance, existing wellheads, and may also interfere with raising and lowering of equipment for operations.

SUMMARY

The present disclosure provides for a land-based drill rig. The land-based drilling rig includes a drill rig floor, the drill rig floor including a V-door, a side of the drill rig floor having the V-door defining a V-door side of the drill rig floor and an opposite V-door side of the drill rig floor opposite the V-door side of the drill rig floor. The land-based drilling rig also includes a mast, the mast mechanically coupled to the drill rig floor. Further, the land-based drilling rig includes at least four support bases, each support base coupled to the drill rig floor by a telescoping support arm, the support base and telescoping arm forming a support, wherein the support bases are square or cylindrical.

The present disclosure provides for a method. The method includes supplying a land-based drilling rig. The land-based drilling rig includes a drill rig floor, the drill rig floor including a V-door, a side of the drill rig floor having the V-door defining a V-door side of the drill rig floor and an opposite V-door side of the drill rig floor opposite the V-door side of the drill rig floor, the drill rig floor in a lowered position. In addition, the land-based drilling rig includes a mast, the mast mechanically coupled to the drill rig floor, and at least four support bases, each support base coupled to the drill rig floor by a telescoping support arm, the support base and telescoping arm forming a support, wherein the support bases are square or cylindrical. In addition, the method includes positioning the land-based drilling rig within a wellsite, the wellsite having at least one row of wells, at least one well having a wellhead and raising the drill rig floor from the lowered position to a raised position using the telescoping support arms. In addition, the method includes moving the land-based drilling rig over the well-head.

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
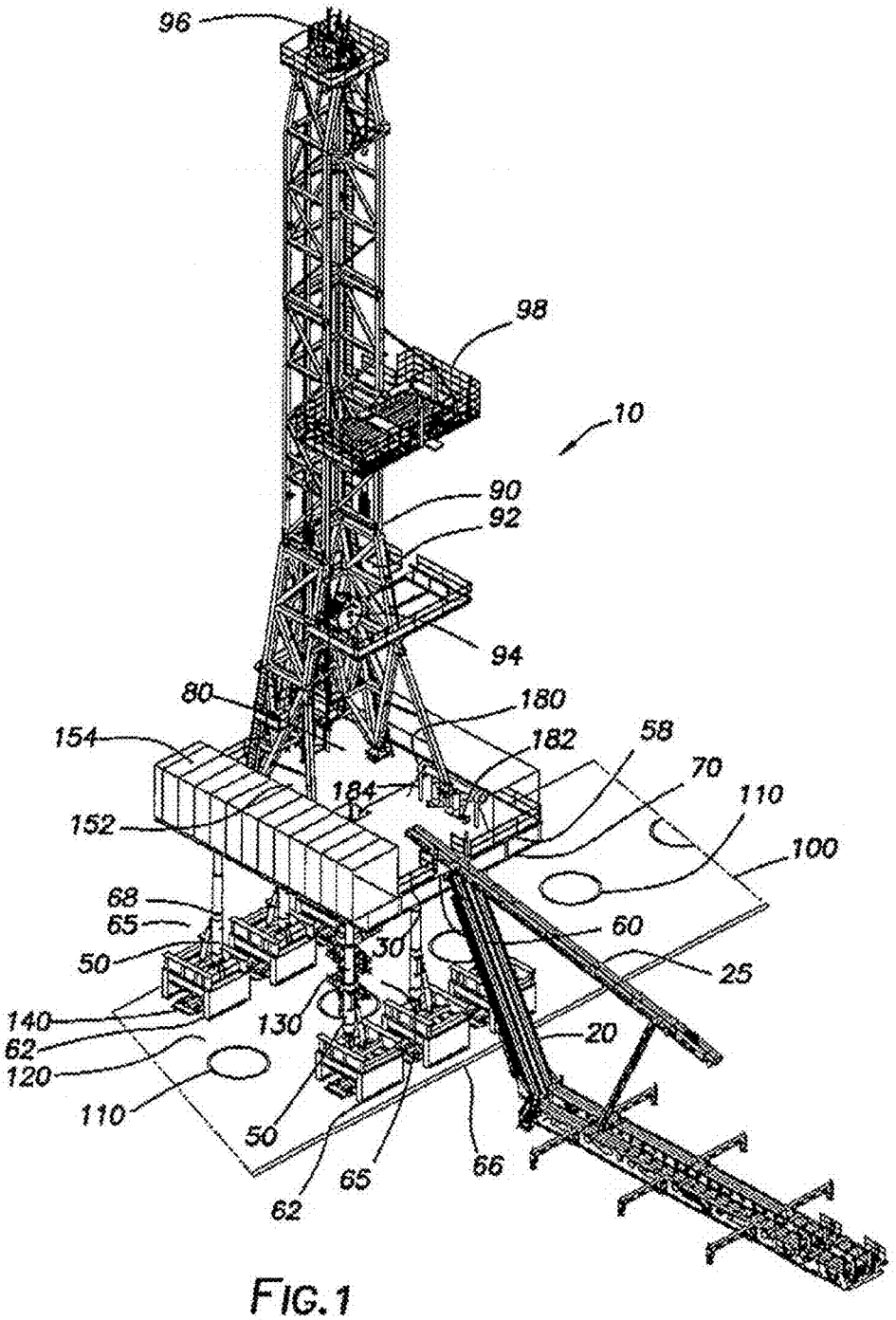
FIG. 1 is a perspective view of a land-based drilling rig in a raised position consistent with at least one embodiment of the present disclosure.
Figure 6:
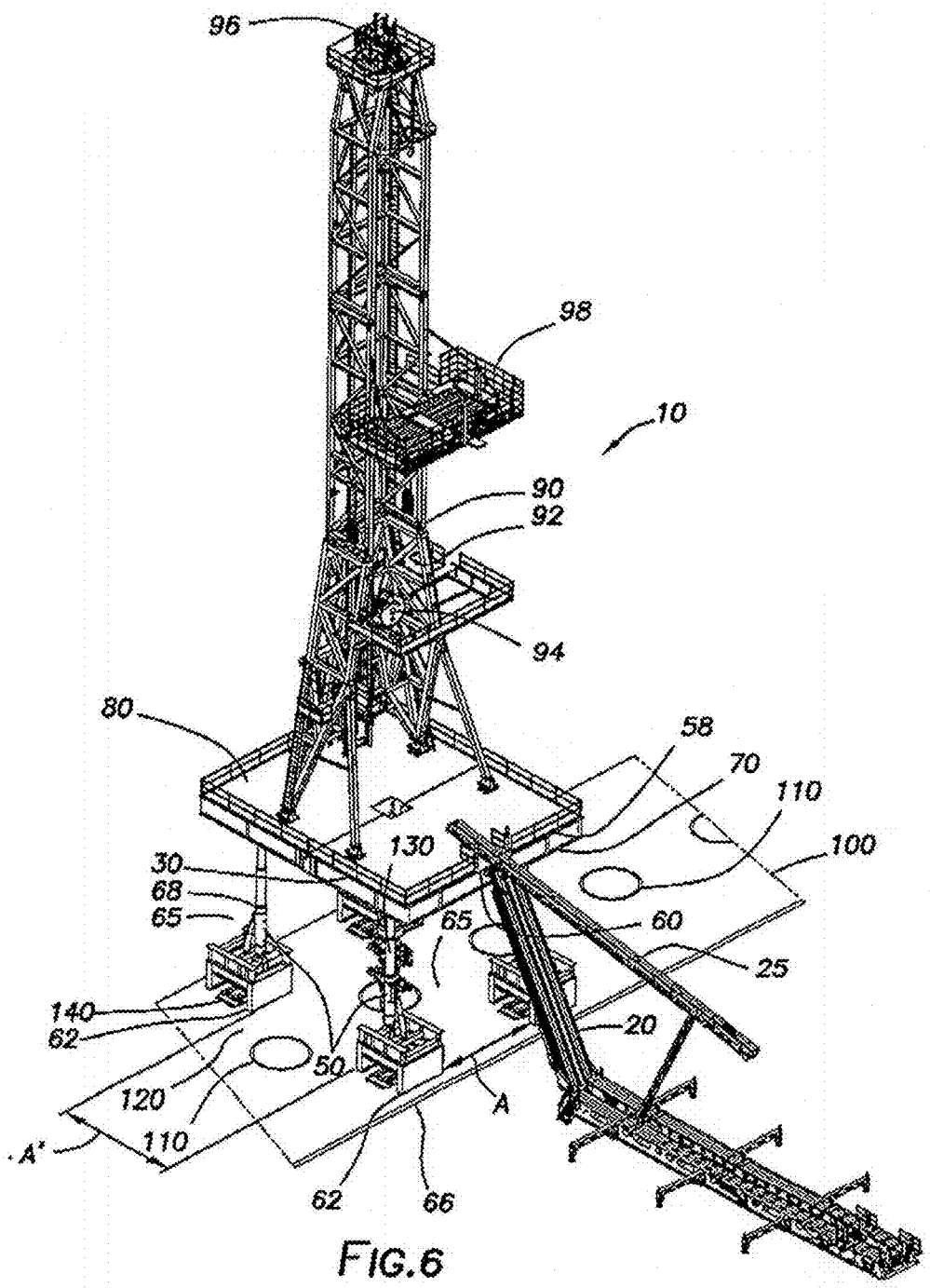
FIG. 6 is a perspective view of a land-based drilling rig in a raised position consistent with at least one embodiment of the present disclosure.

FIGS. 1 and 6 are perspective views of different embodiments of land-based drilling rig 10 in a raised position. Land-based drilling rig 10 may include drill rig floor 30. Drill rig floor 30 is defined by V-door side 58, having V-door or opening 60 positioned thereon. V-door side 58 of drill rig floor 30 is adjacent slide 25 and catwalk 20. Drill rig floor 30 includes driller's side 152, on which driller's cabin 154 is positioned or cantilevered from.

Choke house 180 may be positioned on or cantilevered to drill rig floor 30. In certain embodiments, choke house 180 may be positioned on choke house skid 182. Choke house 180 may include choke manifold 184. A drawworks may be positioned on drill rig floor 30, a drawworks skid, or choke house skid 182.

In some embodiments, additional equipment including, for example and without limitation, mud tanks, trip tanks, process tanks, mud process equipment, compressors, variable frequency drives, or drill line spoolers, may be coupled to land-based drilling rig 10, such as positioned on or cantilevered from drill rig floor 30.

Drill rig floor 30 may be supported by a plurality of telescoping support arms 50. Each telescoping support arm 50 may be mechanically connected to a respective support base 62 forming support 65. In certain embodiments, support bases 62 may be square. In other embodiments, support bases 62 may be cylindrical.

As shown in the embodiment of FIG. 1, at least three supports 65 may be arranged along V-door side edge 70 forming V-door support row 66 and at least three supports 65 may be arranged opposite V-door side edge 80 of drill rig floor 30 forming opposite V-door support row 68. Thus, V-door side 58 is parallel to V-door support row 66 and opposite V-door support row 68.

In the embodiment shown in FIG. 6, land-based drilling rig 10 has only four supports 65. Each of the four supports 65 may be located at or near a corner of drill rig floor 30. In this embodiment, V-door 60 may be positioned between at least two of supports 65 on drill rig floor 30. As exemplified by FIG. 6, supports 65 are positioned such that distance A, A' (wherein distance A is the distance between supports 65 positioned on V-door side 58 of land-based drilling rig 10 and A' is the distance between supports 65 positioned on the driller's side or off-drillers side) between any supports 65 is sufficient to allow wellhead 130 to pass between supports 65 when land-based drilling rig 10 is moved within the wellsite. Distances A, A' may be the same or different.

Figure 2:
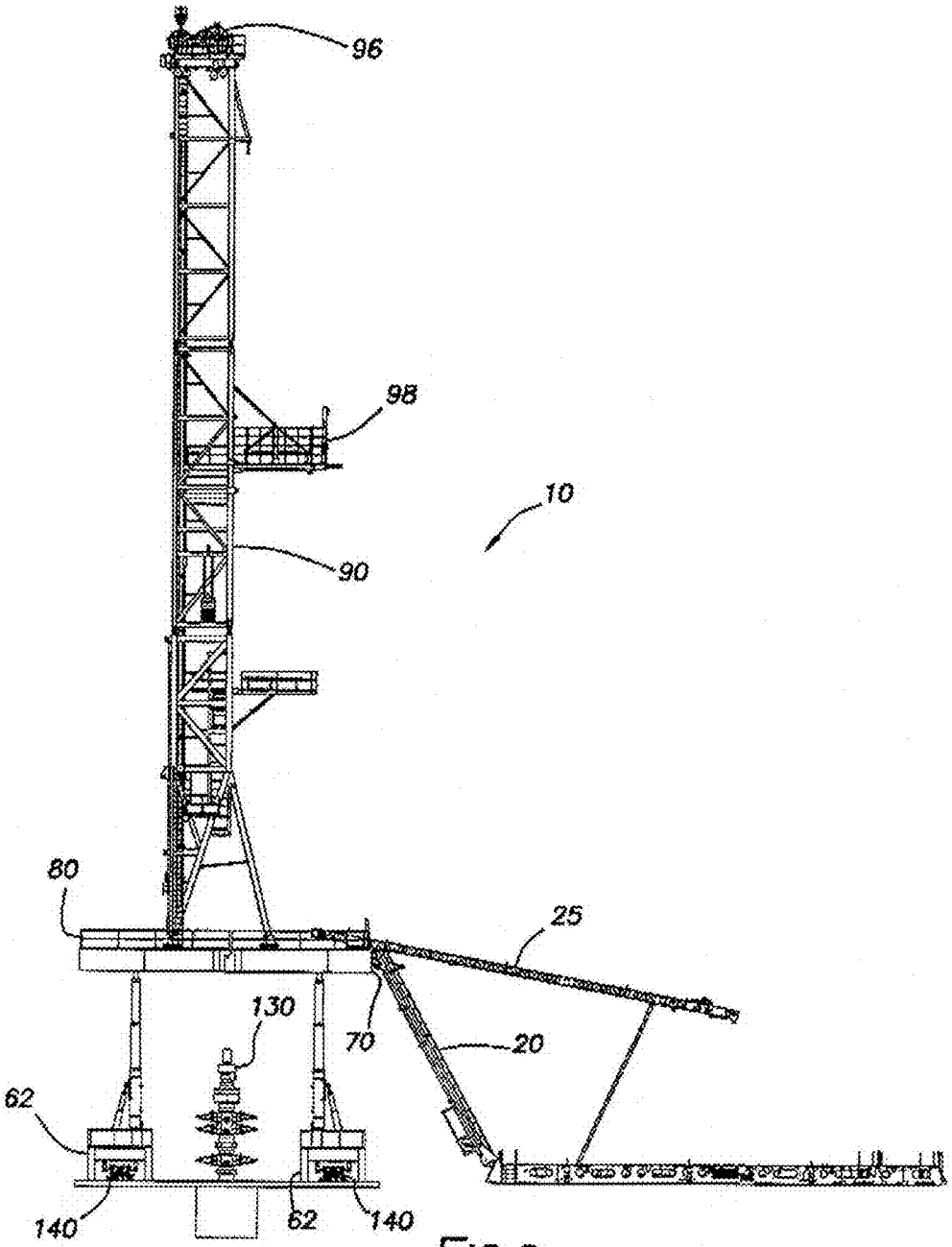
FIG. 2 is a side view of a land-based drilling rig in a raised position consistent with at least one embodiment of the present disclosure.
Figure 3:
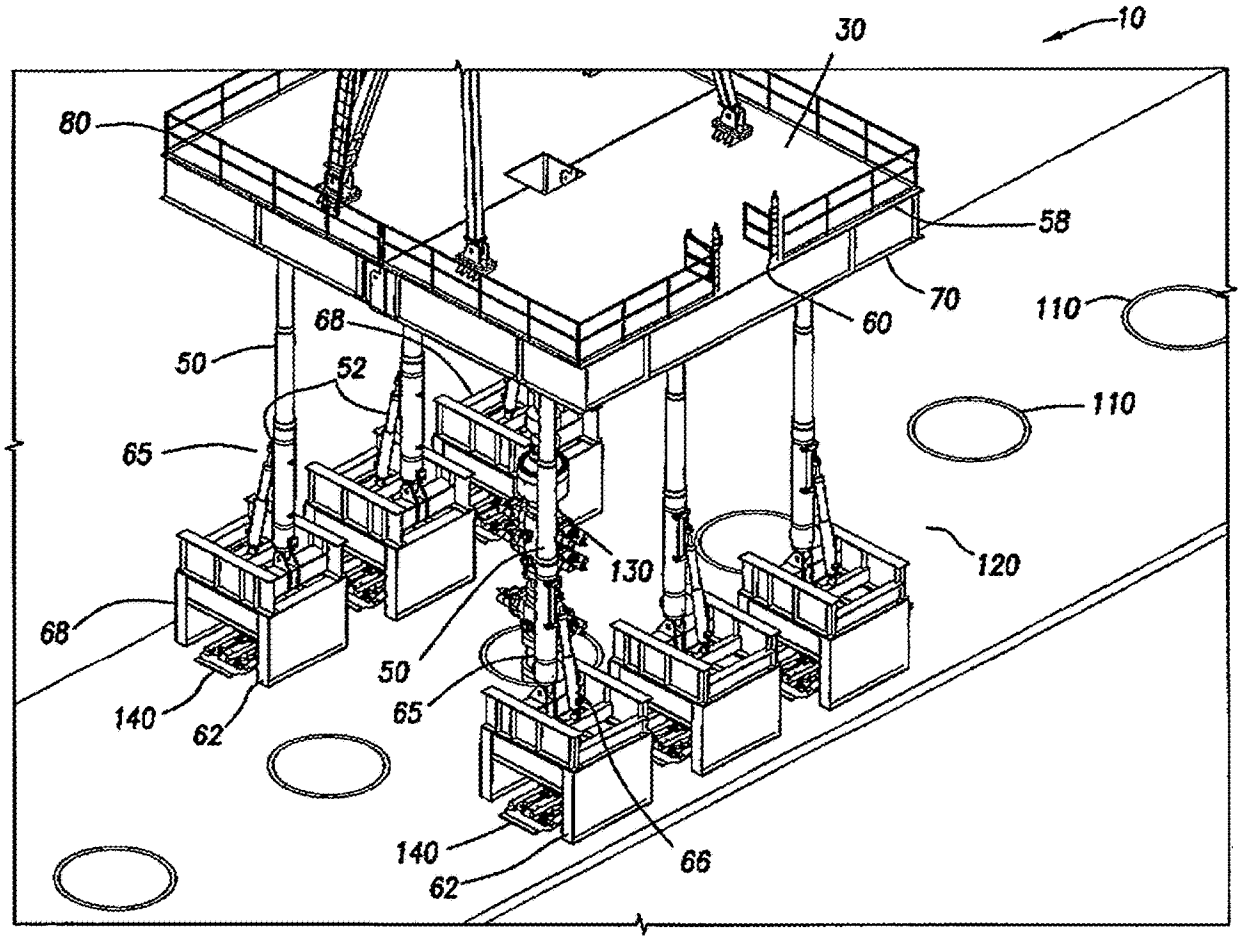
FIG. 3 is a perspective view of a land-based drilling rig in a raised position consistent with at least one embodiment of the present disclosure.
Figure 4:
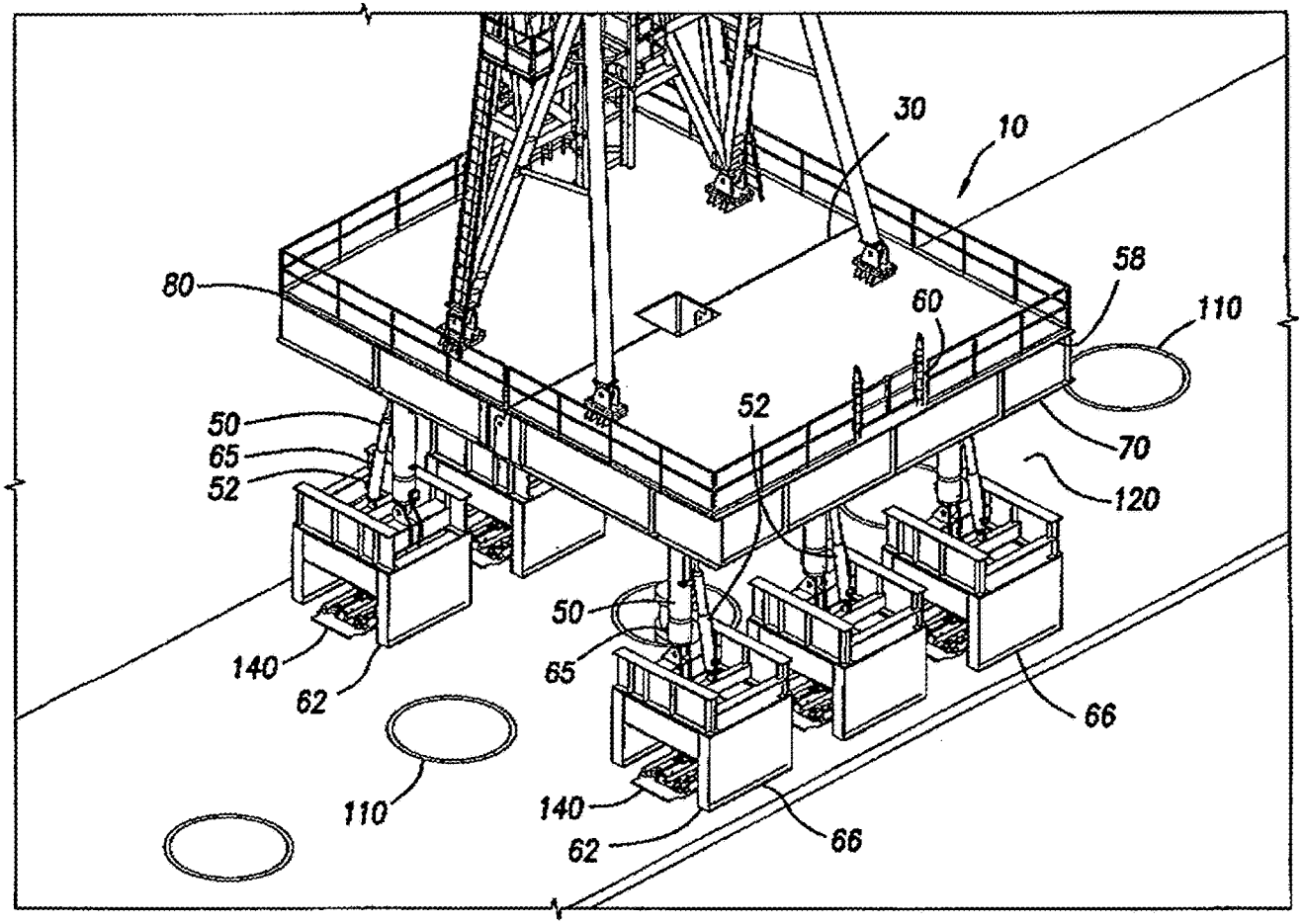
FIG. 4 is a side elevation of a drilling rig consistent in a lowered position consistent with at least one embodiment of the present disclosure.

As shown in FIG. 3, each telescoping support arm 50 may include hydraulic cylinder 52 for raising and lowering drill rig floor 30 using telescoping support arm 50 from a lowered position, as shown in FIG. 4 to an upright position as shown in FIGS. 1-3.

With further attention to FIG. 1, mast 90 may be fixedly or pivotably coupled to drill rig floor 30. Mast 90 may include mast V-door side 92, which faces V-door side 58. Mast V-door side 92 is an open side of mast 90. Equipment positioned within mast 90 may include travelling block 94. Crown block 96 may be positioned on top of mast 90 and pipe rack 98 mechanically attached to mast 90.

Land-based drilling rig 10 is shown in FIG. 1 positioned within wellsite 100 having wells 110 arranged in row 120. Land-based drilling rig 10 may be moved, such as by walking or skidding to different wells 110 in row 120 without breaking down land-based drilling rig 10. V-door support row 66 and opposite V-door support row 68 are spaced apart such that, as shown in FIGS. 1-4, when traveling, wells 110 may pass between V-door support row 66 and opposite V-door support row 68. As shown in FIGS. 1-3, when in the raised position, drill rig floor 30 is positioned using telescoping support arms 50 such that wellhead 130 may pass thereunder.

In some embodiments, as depicted in the figures, land-based drilling rig 10 may include one or more hydraulic walkers 140. Hydraulic walkers 140 may, in some embodiments, be positioned within one or more support bases 62. In some embodiments, hydraulic walkers 140 may be hydraulically actuatable to move or walk land-based drilling rig 10 to a different location in the wellsite. In some embodiments, hydraulic walkers 140 may be operable to move or walk land-based drilling rig 10 in any direction.

Figure 5A:
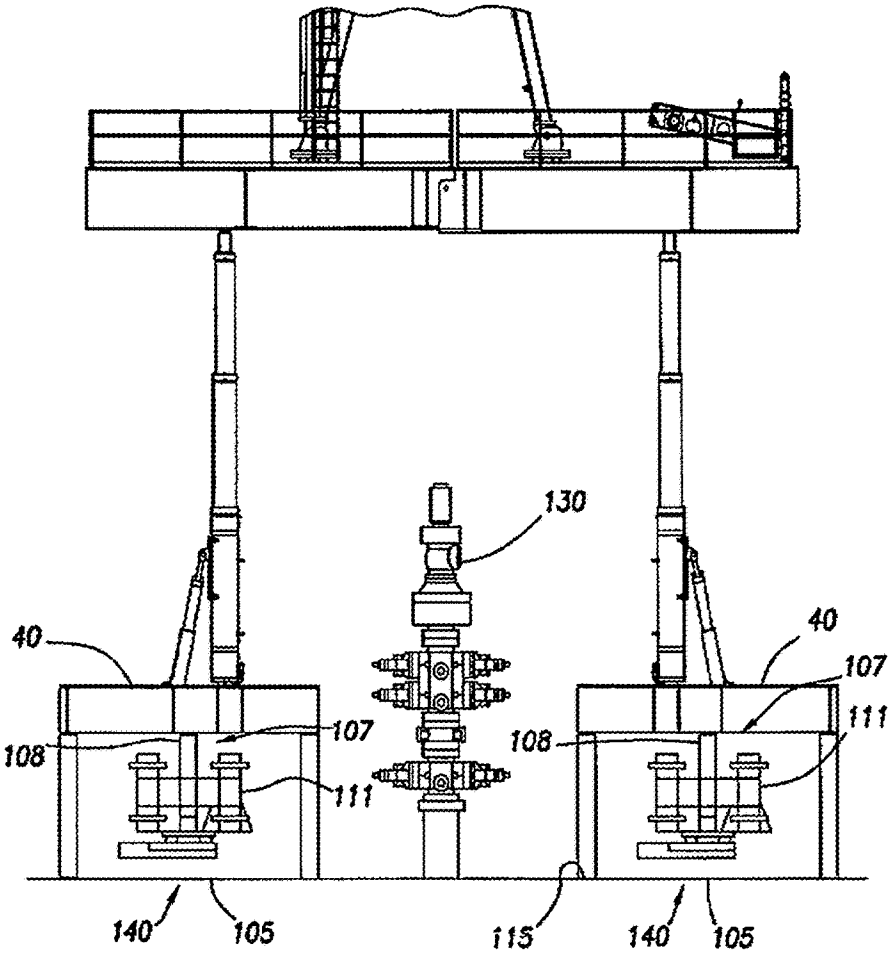
FIGS. 5A-5D are side schematic views of a walking land-based drilling rig consistent with at least one embodiment of the present disclosure.
Figure 5B:
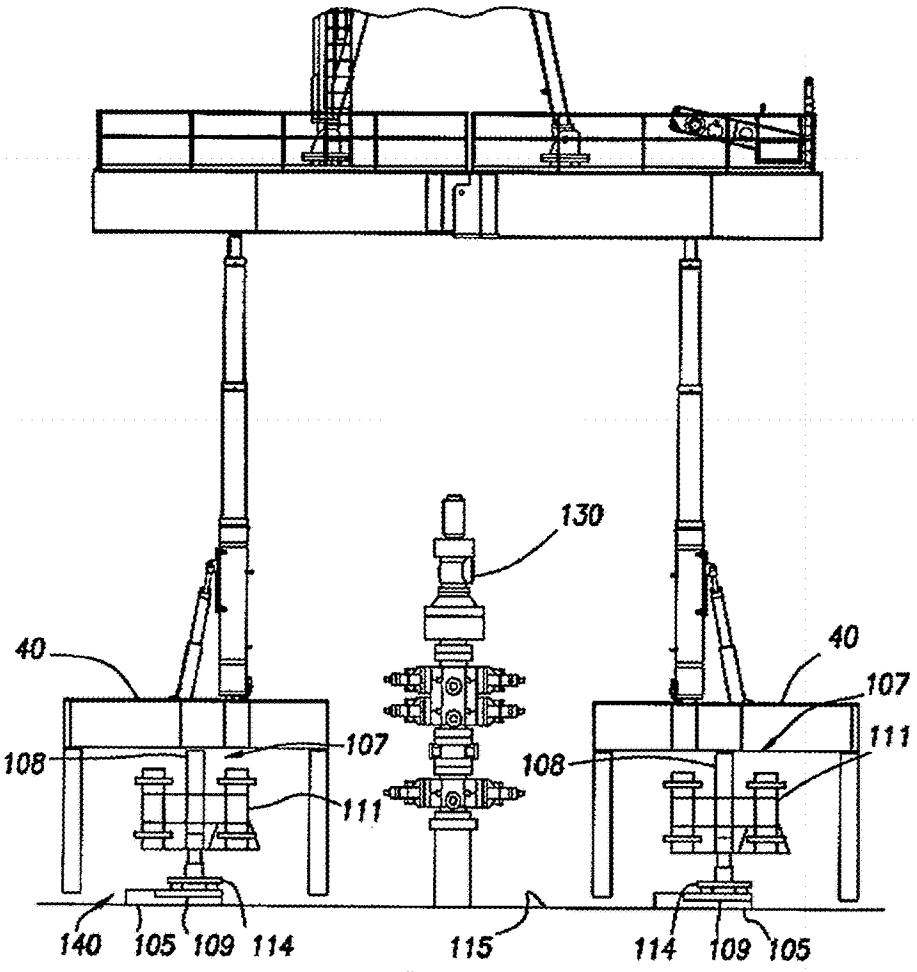

A non-limiting embodiment of a hydraulic walker for use with land-based drilling rig 10 is shown in FIGS. 5A-5D. Hydraulic walkers 140 may include walking foot 105 and hydraulic lift assembly 107 as depicted in FIG. 5A. Walking foot 105 may be a pad or any other structure configured to support the weight of land-based drilling rig 10 and associated equipment during a walking operation as discussed herein below. Hydraulic lift assembly 107 may include one or more hydraulic cylinders 108 positioned to move hydraulic walker 140 between a retracted position, as depicted in FIG. 5A, and an extended position, as depicted in FIG. 5B. Hydraulic lift assembly 107 may be mechanically coupled to column 40 by mounting structure 111. Mounting structure 111 may include any mechanical fasteners, plates, or other adapters to couple between hydraulic lift assembly 107 and column 40. In some embodiments, mounting structure 111 may be an outrigger structure. In a walking operation, depicted in FIGS. 5A-5D, hydraulic walkers 140 may be positionable in a retracted position as shown in FIG. 5A. In the retracted position, column 40 may be in contact with the ground 115, allowing the weight of land-based drilling rig 10 to be supported by column 40. When hydraulic walker 140 is in the extended position, as depicted in FIG. 5B, walking foot 105 may support column 40 above ground 115.

Figure 5C:
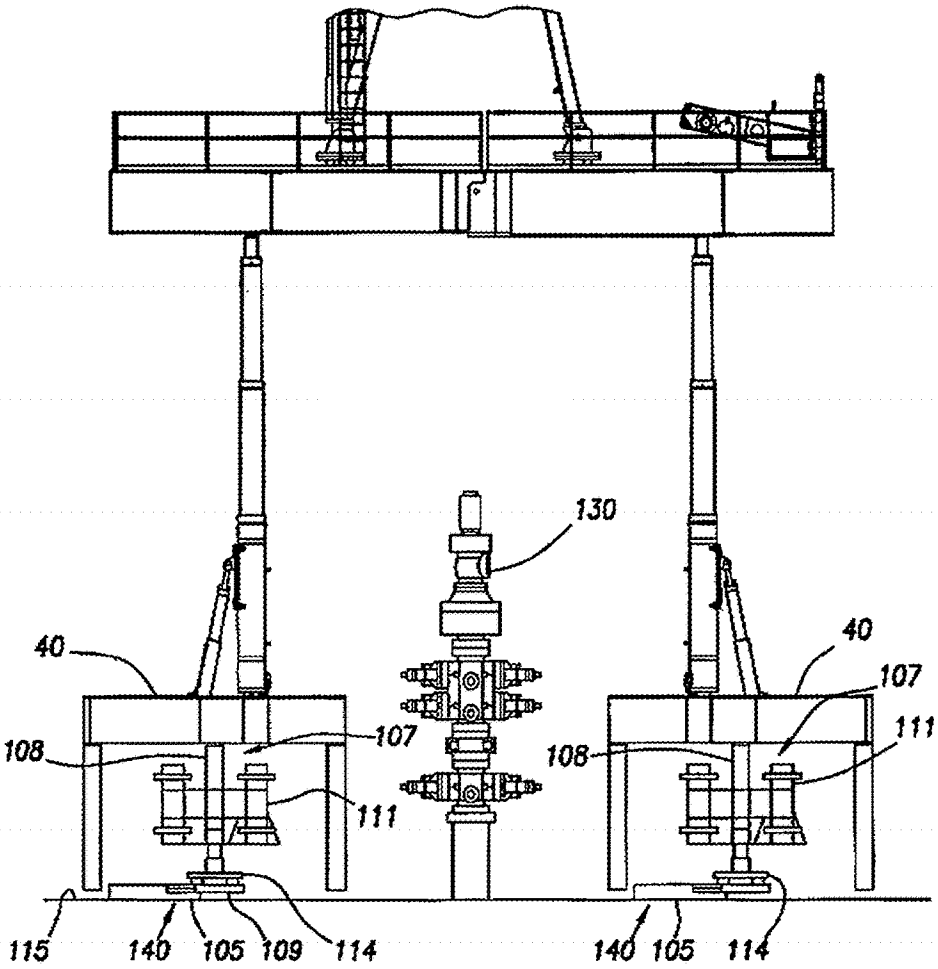
Figure 5D:
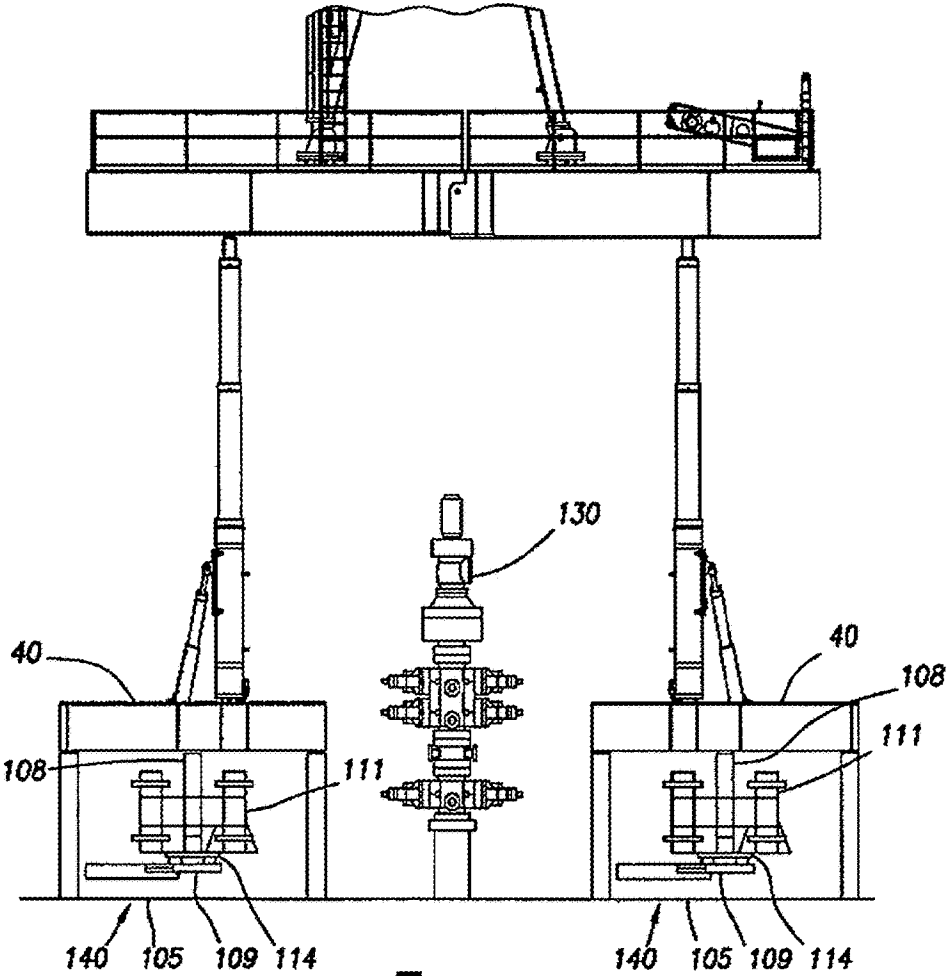

Once hydraulic walker 140 is in the extended position, sliding actuator 109 may be actuated to move walking foot 105 laterally relative to hydraulic lift assembly 107 from a first position to a second position as depicted in FIG. 5C. In some embodiments, one or more bearing surfaces, linear bearings, ball bearings, or roller bearings may be positioned between walking foot 105 and hydraulic lift assembly 107 as understood in the art to, for example and without limitation, bear the weight of land-based drilling rig 10 and any equipment thereon during a walking operation. Sliding actuator 109 may include one or more hydraulic cylinders or other linear actuators 114 used to move walking foot 105 horizontally relative to drilling rig 10. For example, when walking foot 105 is in contact with ground 115 as depicted in FIG. 5B, the movement of walking foot 105 by sliding actuator 109 may cause land-based drilling rig 10 to move along ground 115 to a position as shown in FIG. 5C. Hydraulic lift assembly 107 may retract, lifting walking foot 105 from ground 115 and allowing land-based drilling rig 10 to contact the ground 115 as depicted in FIG. 5D. Sliding actuator 109 may be reactuated with walking foot 105 off ground 115 to cause walking foot 105 to be returned to its original position, resetting hydraulic walkers 140 to the first position as depicted in FIG. 5A.

One having ordinary skill in the art with the benefit of this disclosure will understand that the specific configurations depicted in the figures may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land-based drilling rig comprising:

a drill rig floor, the drill rig floor including a V-door, a side of the drill rig floor having the V-door defining a V-door side of the drill rig floor and an opposite V-door side of the drill rig floor opposite the V-door side of the drill rig floor;

a mast, the mast mechanically coupled to the drill rig floor; and at least four support bases, each support base coupled to the drill rig floor by a telescoping support arm, the support base and telescoping arm forming a support, wherein the support bases are polyhedrons having a square base or are cylindrical and wherein the support bases are arranged in a V-door support row and an opposite V-door support row, each row of support bases having at least three support bases, the V-door support row arranged along the V-door side of the drill rig floor and the opposite V-door support row arranged opposite the V-door side of the drill rig floor or wherein the V-door is positioned between at least two supports, each of the supports is positioned at or near edges of the drill rig floor, and an opening distance between two adjacent supports is A and an opening distance between two other adjacent supports is A', wherein A and A' are greater than the diameter of a wellhead.

2. The land-based drilling rig of claim 1, wherein each telescoping support arm includes a hydraulic cylinder.

3. The land-based drilling rig of claim 2, wherein the telescoping support arm is adapted to raise the drill rig floor from a lowered position to a raised position.

4. The land-based drilling rig of claim 1, wherein the mast is pivotably or fixedly coupled to the drill rig floor.

5. The land-based drilling rig of claim 1, wherein the mast includes a V-door side, the V-door side of the mast facing the V-door side of the drill rig floor, wherein the V-door side of the mast is an open side.

6. The land-based drilling rig of claim 1, further comprising at least one hydraulic walker, the at least one hydraulic walker positioned within a support base.

7. The land-based drilling rig of claim 6, wherein the hydraulic walkers are hydraulically actuable to move or walk the drilling rig.

8. The land-based drilling rig of claim 7 wherein the hydraulic walker comprises:

a walking foot;

a hydraulic lift assembly including a hydraulic cylinder coupled to the walking foot; and a sliding actuator including one or more hydraulic cylinders coupled to the walking foot.

9. The land-based drilling rig of claim 8, wherein at least a portion of the hydraulic walkers is rotatable relative to the support base.

10. The land-based drilling rig of claim 1 further comprising a slide and catwalk adjacent the V-door side of the drill rig floor.

11. The land-based drilling rig of claim 1, further comprising one or more of drill line spooler, hydraulic power unit, compressor, variable frequency drive, mud process equipment, choke manifold, accumulator, mud gas separator, process tank, or trip tank positioned on or cantilevered from the drill rig floor.

12. The land-based drilling rig of claim 1 further comprising a driller's cabin, the driller's cabin positioned on or cantilevered from a driller's side of the drill rig floor.

13. The land-based drilling rig of claim 1 further comprising a choke manifold, the choke manifold positioned on an off-driller's side of the drill rig floor.

14. A method comprising:

supplying a land-based drilling rig, the land-based drilling rig comprising:

a drill rig floor, the drill rig floor including a V-door, a side of the drill rig floor having the V-door defining a V-door side of the drill rig floor and an opposite V-door side of the drill rig floor opposite the V-door side of the drill rig floor, the drill rig floor in a lowered position;

a mast, the mast mechanically coupled to the drill rig floor; and at least four support bases, each support base coupled to the drill rig floor by a telescoping support arm, the support base and telescoping arm forming a support, wherein the support bases are polyhedrons having a square base or are cylindrical; and and wherein the support bases are arranged in a V-door support row and an opposite V-door support row, each row of support bases having at least three support bases, the V-door support row arranged along the V-door side of the drill rig floor and the opposite V-door support row arranged opposite the V-door side of the drill rig floor or wherein the V-door is positioned between at least two supports, each of the supports is positioned at or near edges of the drill rig floor, and an opening distance between two adjacent supports is A and an opening distance between two other adjacent supports is A', wherein A and A' are greater than the diameter of a wellhead;

positioning the land-based drilling rig within a wellsite, the wellsite having at least one row of wells, at least one well having a wellhead;

raising the drill rig floor from the lowered position to a raised position using the telescoping support arms; and moving the land-based drilling rig over the wellhead.

15. The method of claim 14, wherein the land-based drilling rig further comprises at least one walker, the at least one walker positioned within a support base.

16. The method of claim 15, wherein the step of moving the land-based drilling rig comprises:

actuating the at least one walker; and walking the land-based drilling rig.

17. The method of claim 16, wherein the hydraulic walker comprises:

a walking foot;

a hydraulic lift assembly including a hydraulic cylinder coupled to the walking foot; and a sliding actuator including one or more hydraulic cylinders coupled to the walking foot.

18. The method of claim 17, wherein the step of walking the land-based drilling rig further comprises:

positioning the land-based drilling rig at a first position in a wellsite;

extending the hydraulic lifts of the hydraulic walker;

lifting the land-based drilling rig off the ground;

actuating the sliding actuators to move the walking feet from a first position to a second position;

moving the land-based drilling rig in a first direction;

retracting the hydraulic lifts;

placing the land-based drilling rig on the ground; and actuating the sliding actuators to return the walking feet to the first position.

19. The method of claim 18 further comprising:

rotating the hydraulic walkers;

repeating the extending, lifting, actuating, retracting, and reactuating operations; and moving the land-based drilling rig in a second direction.

20. The method of claim 19, further comprising:

repeating the extending, lifting, actuating, retracting, and reactuating operations until the land-based drilling rig is at a desired second position in the wellsite.

21. The method of claim 20, wherein the desired second position is a second wellhead within the wellsite.

22. A land-based drilling rig comprising:

a drill rig floor, the drill rig floor including a V-door, a side of the drill rig floor having the V-door defining a V-door side of the drill rig floor and an opposite V-door side of the drill rig floor opposite the V-door side of the drill rig floor;

a mast, the mast mechanically coupled to the drill rig floor;

at least four support bases, each support base coupled to the drill rig floor by a telescoping support arm, the support base and telescoping arm forming a support, wherein the support bases are polyhedrons having a square base or are cylindrical; and at least one walker, the at least one walker positioned within a support base, the hydraulic walker being hydraulically actuable to move or walk the drilling rig, wherein the hydraulic walker comprises:

a walking foot;

a hydraulic lift assembly including a hydraulic cylinder coupled to the walking foot; and a sliding actuator including one or more hydraulic cylinders coupled to the walking foot.

23. The land-based drilling rig of claim 22, wherein the walking foot of the hydraulic walkers is rotatable relative to the support base.

24. The land-based drilling rig of claim 22, wherein the support bases are arranged in a V-door support row and an opposite V-door support row, each row of support bases having at least three support bases, the V-door support row arranged along the V-door side of the drill rig floor and the opposite V-door support row arranged opposite the V-door side of the drill rig floor.

25. The land-based drilling rig of claim 22, wherein the V-door is positioned between at least two supports.

26. The land-based drilling rig of claim 25, wherein each of the supports is positioned at or near edges of the drill rig floor.

* * * * *